US005177815A

United States Patent [19]

Andujar

[11] Patent Number: 5,177,815

[45] Date of Patent: Jan. 12, 1993

[54] PROTECTIVE HEADGEAR

[76] Inventor: Edward M. Andujar, 87 W. Riverside Dr., Mays Landing, N.J. 08330

[21] Appl. No.: 506,071

[22] Filed: Apr. 9, 1990

[51] Int. Cl.[5] ..... A42B 3/00

[52] U.S. Cl. ..... 2/411; 2/425

[58] Field of Search ..... 2/410, 412, 411, 421, 2/425

[56] References Cited

U.S. PATENT DOCUMENTS

| | | | |
|---|---|---|---|
| 2,296,335 | 9/1942 | Brady | 2/412 |
| 3,242,500 | 3/1966 | Derr | 2/412 |
| 3,594,815 | 7/1971 | Reese | 2/421 |
| 3,934,271 | 1/1976 | Rhee | 2/424 |
| 3,992,722 | 11/1976 | Rhee | 2/411 |
| 4,058,854 | 11/1977 | Rhee | 2/425 |
| 4,075,717 | 2/1978 | Lemelson | 2/412 |
| 4,279,038 | 7/1981 | Brückner et al. | 2/425 |
| 4,706,305 | 11/1987 | Cho | 2/425 |
| 4,845,786 | 7/1989 | Chiarella | 2/412 |

FOREIGN PATENT DOCUMENTS

| | | | |
|---|---|---|---|
| 3632525 | 3/1988 | Fed. Rep. of Germany | 2/410 |
| 2250513 | 7/1975 | France | 2/410 |
| 8501665 | 4/1985 | PCT Int'l Appl. | 2/425 |

*Primary Examiner*—Werner H. Schroeder
*Assistant Examiner*—Michael A. Neas
*Attorney, Agent, or Firm*—John S. Hale

[57] ABSTRACT

A protective headgear conforming to a person's head and capable of absorbing energy. The headgear is constructed of a base member of resilient foam and pad members are secured to the resilient foam. The entire headgear is covered with tough pliable surface casing. The headgear defines a front opening which is generally contoured and shaped to conform with the periphery of a person's eyes and extending downward along the cheek area to expose the chin and neck and two ear openings. A pair of cross members formed on the top of the headgear retain the headgear on a person's head and define ventilation openings.

10 Claims, 3 Drawing Sheets

FIG. 5
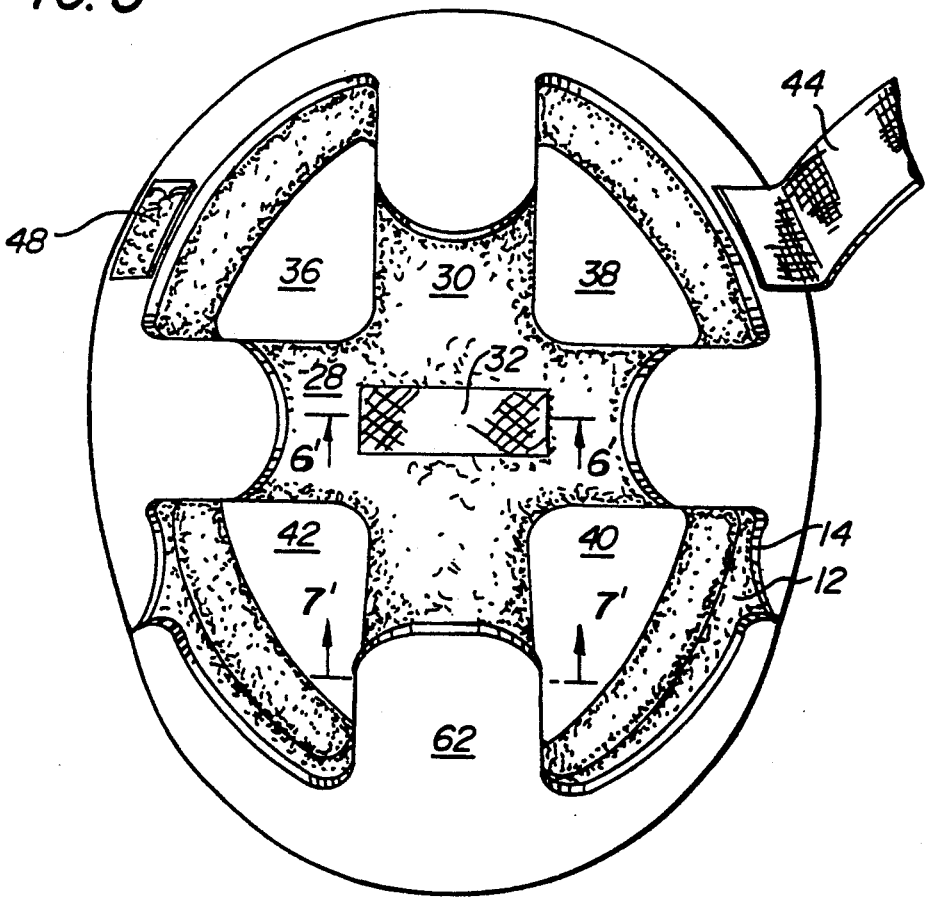
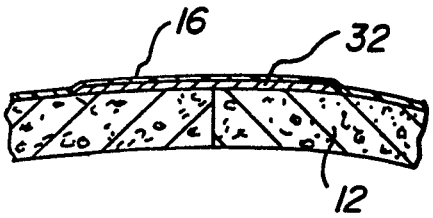
FIG. 6
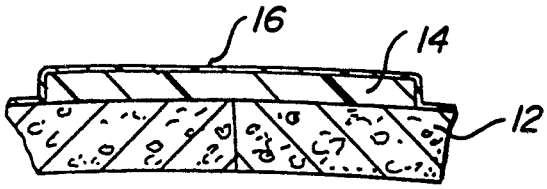
FIG. 7

PROTECTIVE HEADGEAR

BACKGROUND OF THE INVENTION

1. Field of the Invention

The present invention relates to a headgear for protecting a wearer from the forceful blows of participants in karate or other martial arts activities and, more particularly, to headgear designed to protect the wearer from the force of blows to the head, namely, the back and sides of the head.

2. Description of Prior Art

In martial arts activities such as karate, participants use their hands, fists, arms and feet as weapons to strike out at the other person's body or head. These blows may result in injury unless the force of the blow is lessened prior to physical contact. A reduction in the force of the blows may be achieved by participants wearing protective gear which will absorb the force of the punch. Thus, benefits of full contact practice can be obtained while the injury problem is minimized if blows can be fully delivered by the participants during the practice sessions.

Because of the strenuous activity of the wearer while using a protective device, it is a necessity for the headgear to be lightweight and cover those areas of the head requiring protection, while permitting maximum ventilation and reducing sweat collection. Furthermore, such protective headgear must allow for freedom of vision and hearing so that the user can participate in the activity intended.

Typical devices have been designed in an effort to achieve such objectives and these are adequately described in the patent literature.

U.S. Pat. Nos. 3,934,271; 3,992,722; and 4,058,854 disclose protective headgear unitarily molded of resilient foam and covered with a smooth tough pliable surface coating such as polyvinylchloride. The headgear are worn on a person's head and have openings conforming to the person's eyes, ears, nose, mouth and chin and are provided with a downwardly projecting flap which extends to the bottom of the neck of the wearer. In certain modifications to the headgear, removable transparent shield screens are mounted across the openings and hemispherical plates can be disposed on top of the headgear. In the '772 patent, reinforcement strips are adhered to the surface coating to reinforce the hole defining areas.

In U.S. Pat. No. 4,279,038, a head protector is disclosed which is constructed of a body of form-molded polyurethane which surrounds the head on all sides, extending from the beginning of the neck vertebrae to the back of the head, with a bowl-shaped region covering the chin. The molded body has openings formed therein for the eyes, nose, mouth and ears and a parting slot extends from the mouth opening over the chin bowl. Two longitudinal parallel slots extend over the occipital region of the head and end at the lower edge of the molded body, forming a free strap, the free strap extending from the upper region of the molded body to the beginning of the neck vertebrae.

U.S. Pat. No. 4,706,305 discloses headgear fabricated of foam coated with a pliable coating. The foam is shaped as a circumferential strip adapted to encompass the head of the wearer and includes a first portion extending across the wearer's forehead, a second portion extending across the back of the wearer's head and intermediate portions extending across the sides of the wearer's head. The headgear also includes ear protectors extending downward from the intermediate portions with each ear protector, including an enlarged opening overlaying the wearer's ear, and apertures formed in the headgear adjacent the opening for relieving air pressure when a blow is delivered to the ear portion.

As illustrated above, these prior art headgear devices disclose the efforts being made in an attempt to solve the problem of designing protective lightweight economical headgear which prevent injuries in the martial arts sports. Some of these headgear cover more of the wearer's head than necessary, which restricts desired ventilation and places stress points on the neck vertebrae. Other devices unnecessarily limit the wearer's vision, hearing or freedom of movement. The present invention achieves purposes, objectives and advantages through new, useful and unobvious constructions and arrives at the device which is available at a reasonable cost through utilization of readily available materials and is a lightweight, protective unencumbering headgear.

SUMMARY OF THE INVENTION

The present invention is directed to protective headgear worn on a person's head and generally conforming to the shape of a person's head, constructed of a unitary base foam capable of absorbing energy. The unitary base foam defines a front opening outlining the face portion of the head including the eyes, nose, mouth, chin and throat, oblong ear openings and cross members adapted to retain the headgear on a person's head and provide upper head openings for ventilation. Protective pads are secured to said base foam for protection of the forehead, sides of the head, including substantially surrounding said ear holes, and the rear of the head, the base foam and protective padding being covered by a smooth plastic coating.

An elastic strap is secured to one side of the headgear and is adapted to be secured to the other side of the headgear with a VELCRO fastener.

It is an object of this invention to provide a unitary novel protective headgear easily adapted to be worn on the head of a person, which can be easily placed on the head or taken off.

It is another object of the invention to provide a novel protective headgear having a simplified construction, made of resilient material having a tough outer casing.

Another object of this invention is to provide a novel protective headgear having a simplified construction, with separate openings for the face and ears and protective padding in areas in which injury can occur.

Other features and advantages of the various embodiments of the protective headgear of the invention will become apparent from the following of the specific embodiments herein, taken in conjunction with the drawings.

BRIEF DESCRIPTION OF THE DRAWINGS

FIG. 5 is a top plan view of the headgear of FIG. 1;

FIG. 6 is a cross sectional view taken along section 6'—6' of FIG. 5; and

FIG. 7 is a cross sectional view taken along section 7'—7' of FIG. 5.

DETAILED DESCRIPTION OF THE DRAWINGS

Figure 1:
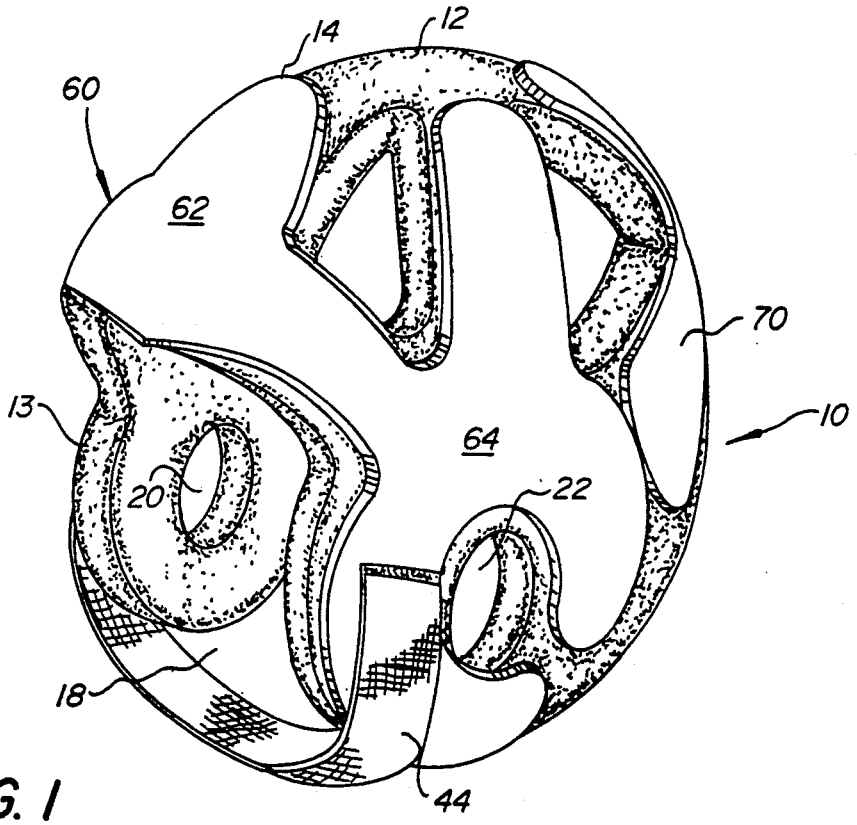
FIG. 1 is a perspective view of the protective headgear of the invention.

The preferred mode and specific embodiment of the invention is illustrated in the drawings as shown by FIGS. 1-7. The invention comprises a protective headgear indicated by the numeral 10 with a head-shaped shell configuration of unitary molding having a plurality of cutouts or openings to accommodate the various parts of a person's head when worn. The headgear body 12 comprises a unitary protective member molded from a suitable resilient material capable of absorbing energy, such as a plastic, namely, a ¾ inch thick INSOLITE polyvinylchloride with EVA shell padding 14 to give extra protection to the wearer. A suitable surface coating 16, preferably smooth, covers the entire resilient surface to make the headgear tough, pliable and tear-resistant. This coating material, which is preferably a polyvinylchloride, is applied to the surface of the headgear by dipping, applying or securing a coating of a suitable plastic material or the like. Thus, the coating or casing which covers the headgear provides a smooth flexible tough covering which is resistant to tearing or abrasion. A cross section showing the three structural components is seen in FIG. 7.

Figure 4:
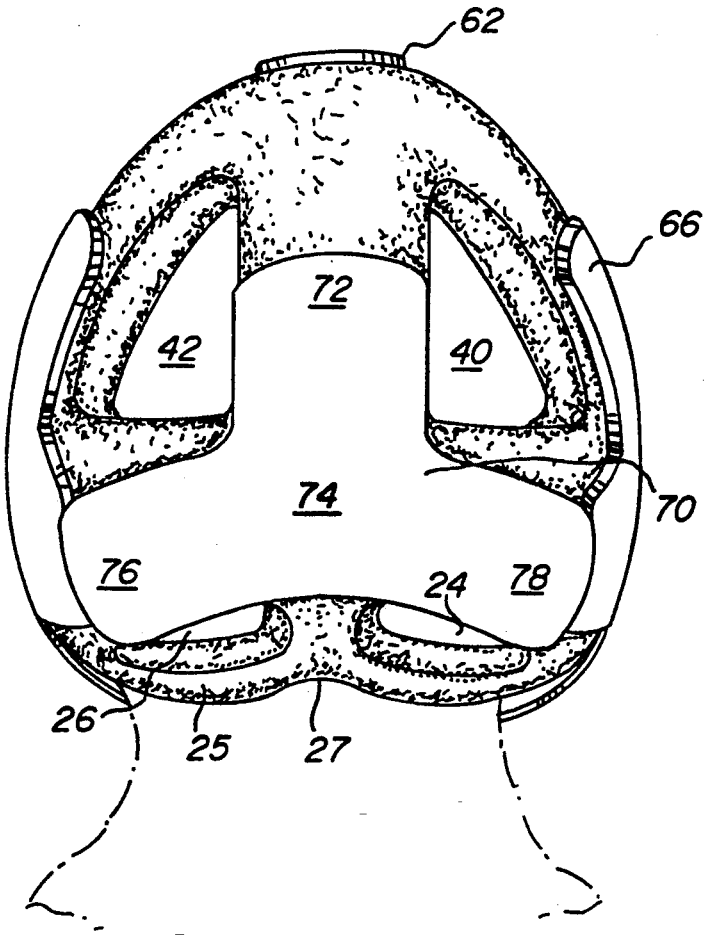
FIG. 4 is a rear elevational view of the headgear of FIG. 1 placed on a wearer's head.

A face opening 18 is defined in the front of the headgear to provide an area which extends from over the eyes of the individual down the sides of the cheek, opening up the chin area and leaving the front of the neck exposed. Thus, the face opening permits one to see out of the headgear with full vision, as well as permitting the nose to be open for breathing and does not cover the mouth, allowing speech and breathing. Similarly, oblong shaped openings 20 and 22 which taper inward generally outline the ears for hearing purposes so that no acoustical difficulties are encountered and no pressures to the ear region are felt. At the rear of the headgear oblong shaped neck openings 24 and 26 are formed as shown in FIG. 4, which provide ventilation for the right neck portion and the left neck portion. It should be noted that a rear neck bar 25 which forms the base of the neck opening is slightly V shaped 27 to ride over the beginning of the neck vertebrae and is reinforced by a strap 35 which runs along the bottom flat surface 13 of the base foam.

Figure 2:
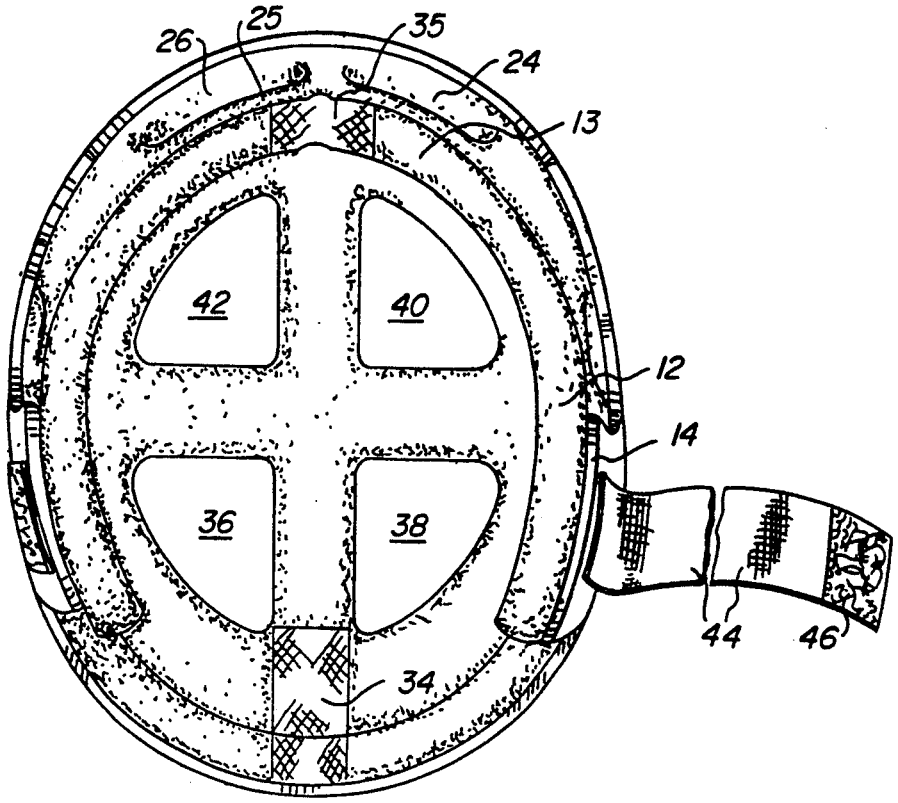
FIG. 2 is a bottom plan view of the headgear of FIG. 1.
Figure 3:
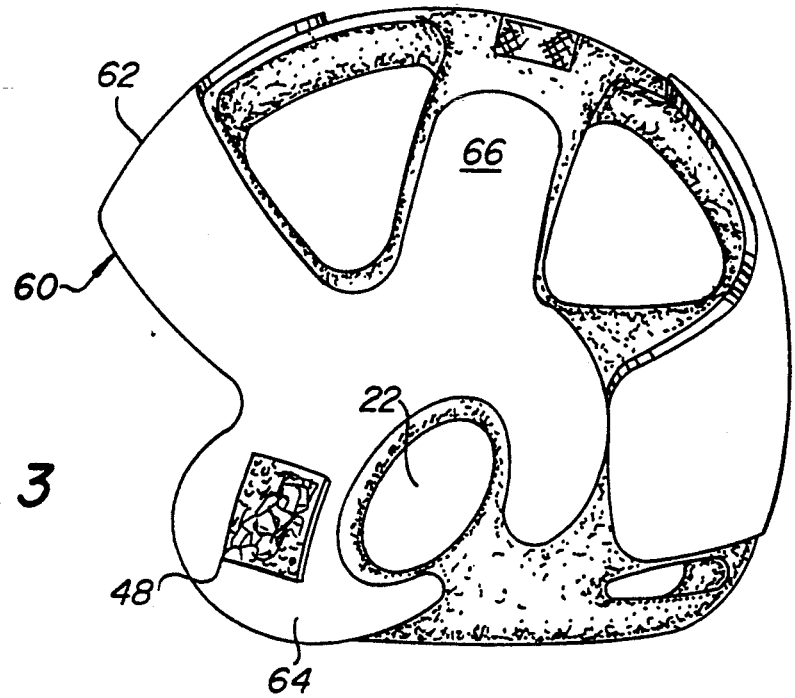
FIG. 3 is a side elevational view of the headgear of FIG. 1.

A pair of cross members 28 and 30 extend over the top of the head in a cross shaped construction and are reinforced with a nylon reinforced vinyl strap 32. This relationship is clearly shown in FIGS. 5 and 6. Additional support in the interior of the headgear as shown in FIG. 2 is provided by nylon reinforced vinyl straps 34 and 35. The cross members 28 and 30 define openings 36, 38, 40 and 42 in the top of the headgear, which provide ventilation to the wearer of the headgear, while cross members 28 and 30 provide protection to the top of the head of the person and keep the headgear seated on the wearer's head. An elastic chin strap 44 with a VELCRO fastener section 46 on one end is adhesively secured to one side of the headgear and a mateable VELCRO fastener 48 is adhesively secured to the other side of the headgear.

The elastic chin strap 44 prevents the headgear from slipping up or around the face of the wearer. Attachment and separation of the VELCRO fastener allows the headgear to be easily removed or held on the head of the user.

The base foam 12 is provided with areas of protective padding in the form of a shell foam ethylvinylacetate (EVA) ¼ inch thick #10 pound high density to give extra protection to the wearer. The protective padding comprises a front protective pad or shell 60, having a front section 62 which extends over the forehead up cross member 30, two C shaped ear sections 64 which extend substantially around the right and left ear openings 20 and 22 and an ear projection section 66 which extends upward along cross member 28 covering the sides of the head. A rear protective pad 70 which is substantially T shaped (see FIG. 4) with the inverted base 72 extends up cross member 30 and the bar 74 extending over to the right neck opening 24 and left neck opening 26 with ends 76 and 78 abutting the forward edge of ear sections 64.

As seen from the above description, the headgear 10 is adapted to be worn on the head of a person to protect the head from injury while at the same time providing openings of the various parts of the head to permit seeing, speaking, hearing, ventilation, etc. The headgear is thus easily placed on the head or taken off and, because it is not rigid, it tends to conform easily to the head and various features of the head of the wearer. The material of the headgear absorbs the force of the blow to protect the head of the wearer.

While various embodiments of the present invention have been shown and described herein for purposes of illustration, it will be apparent that other variations and embodiments are considered to fall within the scope of the defined invention.

What is claimed is:

1. A protective headgear worn on a person's head and capable of absorbing energy; said headgear comprising a base member of resilient foam means, padding means secured to said base member resilient foam means, said padding means comprising a foam of harder composition than said base member foam means, said base member and said padding means being coated with a tough pliable surface casing completely enclosing said base member and said padding means, said headgear defining a front opening generally contoured and shaped to conform with the periphery of a person's eyes and extending downward along the cheek area leaving the mouth and chin open, cross members formed on the top of said headgear adaptively retaining the headgear on a person's head, said cross members defining ventilation openings with reinforcing means secured over at least one of said cross members at a junction of said cross members.

2. A protective headgear as claimed in claim 1, wherein said base member foam means is a polyvinylchloride foam.

3. A protective headgear as claimed in claim 1, wherein said padding means foam is ethylvinylacetate.

4. A protective headgear as claimed in claim 3, wherein said ethylvinylacetate is about ¼ inch thick and has a high density.

5. A protective headgear as claimed in claim 3, wherein said base member foam is about ¾ inch thick.

6. A protective headgear as claimed in claim 1, wherein said padding means comprises a rear padding member and a front padding member.

7. A protective headgear as claimed in claim 6, wherein said rear padding member is substantially T shaped with the T base extending up one of said cross members and the T bar forming a line over the base of the wearer's neck.

8. A protective headgear as claimed in claim 6, wherein said front padding member comprises a front padding section covering the forehead of said wearer and extending upward over one of said cross members, identical ear sections extending from said front section forming a protective area around an ear opening defined in said headgear, each ear section including a projection extending up a cross member perpendicular to a cross member contacting said front padding forehead section.

9. A protective headgear as claimed in claim 1, wherein said surface casing is polyvinylchloride.

10. A protective headgear as claimed in claim 1, including elastic strap means secured to said headgear, said elastic strap means being secured on one side of said headgear and being adapted to be secured to the other side of said headgear with a hook and loop fastening means.

* * * * *